US007455387B2

(12) United States Patent
Cunnington et al.

(10) Patent No.: US 7,455,387 B2
(45) Date of Patent: Nov. 25, 2008

(54) PRINTHEAD WITH WASTE INK DRIP BIB

(76) Inventors: James Matthew Cunnington, 9285 SW. Apache Dr., Tualatin, OR (US) 97062; David R. Koehler, 17400 SW. Parrett Mountain Rd., Sherwood, OR (US) 97140

( * ) Notice: Subject to any disclaimer, the term of this patent is extended or adjusted under 35 U.S.C. 154(b) by 378 days.

(21) Appl. No.: 11/239,989

(22) Filed: Sep. 30, 2005

(65) Prior Publication Data

US 2007/0076048 A1 Apr. 5, 2007

(51) Int. Cl.
*B41J 2/165* (2006.01)

(52) U.S. Cl. ..... 347/36

(58) Field of Classification Search ..... 347/36, 347/29, 32

See application file for complete search history.

(56) References Cited

U.S. PATENT DOCUMENTS

| | | | | |
|---|---|---|---|---|
| 6,550,882 | B2 * | 4/2003 | Koitabashi et al. | 347/8 |
| 7,275,802 | B2 * | 10/2007 | Berardelli et al. | 347/22 |
| 7,422,308 | B2 * | 9/2008 | Iwasaki | 347/29 |
| 2003/0128250 | A1 * | 7/2003 | Booth | 347/22 |
| 2004/0061745 | A1 * | 4/2004 | Salzer | 347/78 |

* cited by examiner

*Primary Examiner*—An H Do
(74) *Attorney, Agent, or Firm*—Marger Johnson & McCollom, P.C.

(57) ABSTRACT

A printhead is provided that includes a waste ink drip bib located adjacent to the lower edge of the printhead face and includes a funnel structure to direct the flow of waste ink to a centrally located lower opening.

20 Claims, 5 Drawing Sheets

PRINTHEAD WITH WASTE INK DRIP BIB

BACKGROUND OF THE DISCLOSURE

In various modes of operation, ink must be purged from printheads to ensure proper operation of the printhead. When a solid ink printer is initially turned on, the solid ink must be melted or remelted and the printhead must be purged to clear the printhead of any solidified ink in the printhead. The word "printer" as used herein encompasses any apparatus, such as digital copier, bookmaking machine, facsimile machine, multi-function machine, etc. that performs a print outputting function for any purpose.

When ink is purged through the printhead, the ink flows down and off the face of the printhead typically to a waste tray positioned below the printhead. Absent any additional structure, the ink can flow freely along the bottom edge of the printhead and drip from the printhead anywhere along that bottom edge. To help control this dripping flow of waste ink, a drip bib may be added near the bottom edge of the printhead.

FIG. 1 is front elevation view of printhead 20 utilizing a conventional straight-edged drip bib 22. The drip bib 22 uses the surface tension of the ink 24 to help the ink to flow off the bottom edge 26 of the drip bib 22. This conventional drip bib 22, however, results in splattering of unwanted drops of ink throughout the interior of the printer. As shown in FIG. 1, as the flow of ink 24 diminishes, the ink drips from the bottom edge 26. The surface tension of the ink 24 can causes a phenomenon called satellite drops in which a small portion of a stream of ink separates from a drop. This small portion can rebound off-center from the drop or the amount of ink still on the drip bib causing the satellite drop to possibly contact neighboring components.

SUMMARY OF THE DISCLOSURE

One embodiment is a printhead that includes a waste ink drip bib located adjacent a lower edge of the face of the printhead. The waste ink drip bib includes a funnel for directing a flow of waste ink away from the printhead face.

Another embodiment is a method of disposing of waste ink from a printhead that includes attaching a waste ink drip bid near a lower edge of the printhead with the waste ink drip bib including a funnel shape having downwardly sloping portions. The method further includes directing a flow of waste ink laterally with the downwardly sloping portions of the funnel shape to a lower opening in the funnel. Another embodiment is a printer that includes a printhead that has a waste ink drip bib positioned near a bottom edge of a face of the printhead. The waste ink drip bib includes later surfaces substantially perpendicular to the face of the printhead arranged to direct a waste ink to a central portion of the waste ink drip bib.

DETAILED DESCRIPTION

Figure 1:
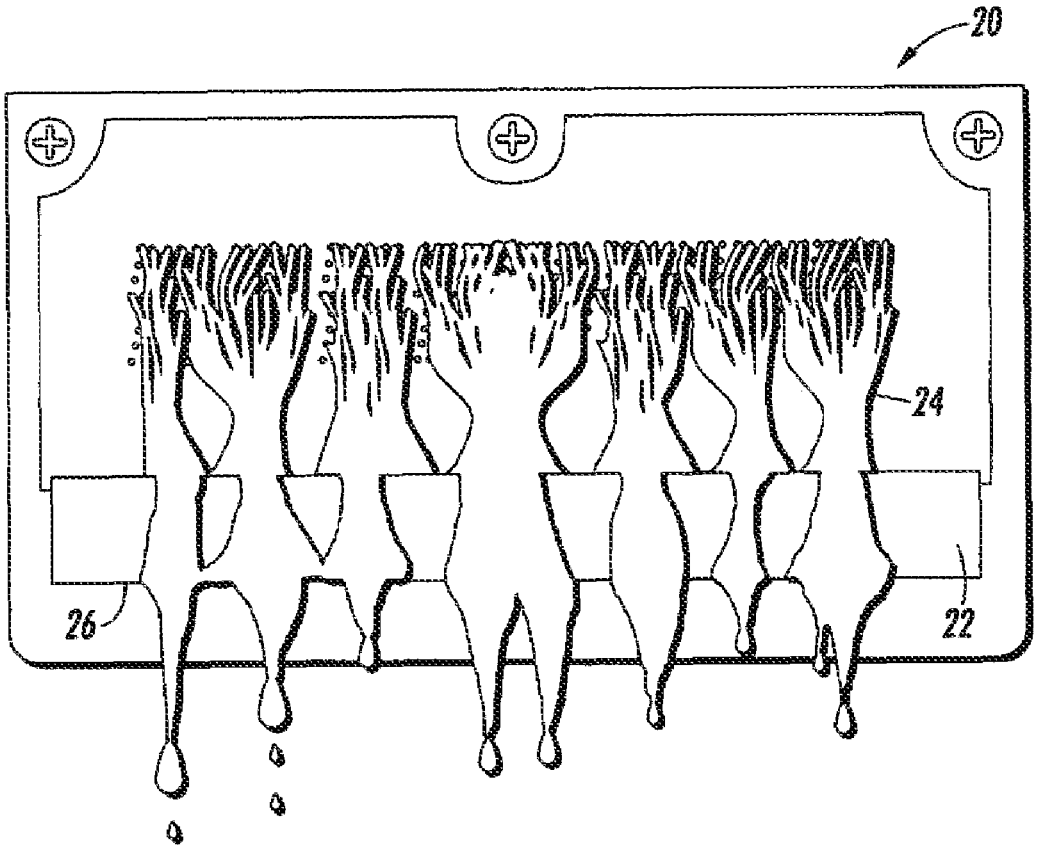
FIG. 1 PRIOR ART
FIG. 1 is a front elevation view of a printhead showing waste ink dripping from a conventional waste ink drip bib.
Figure 2:
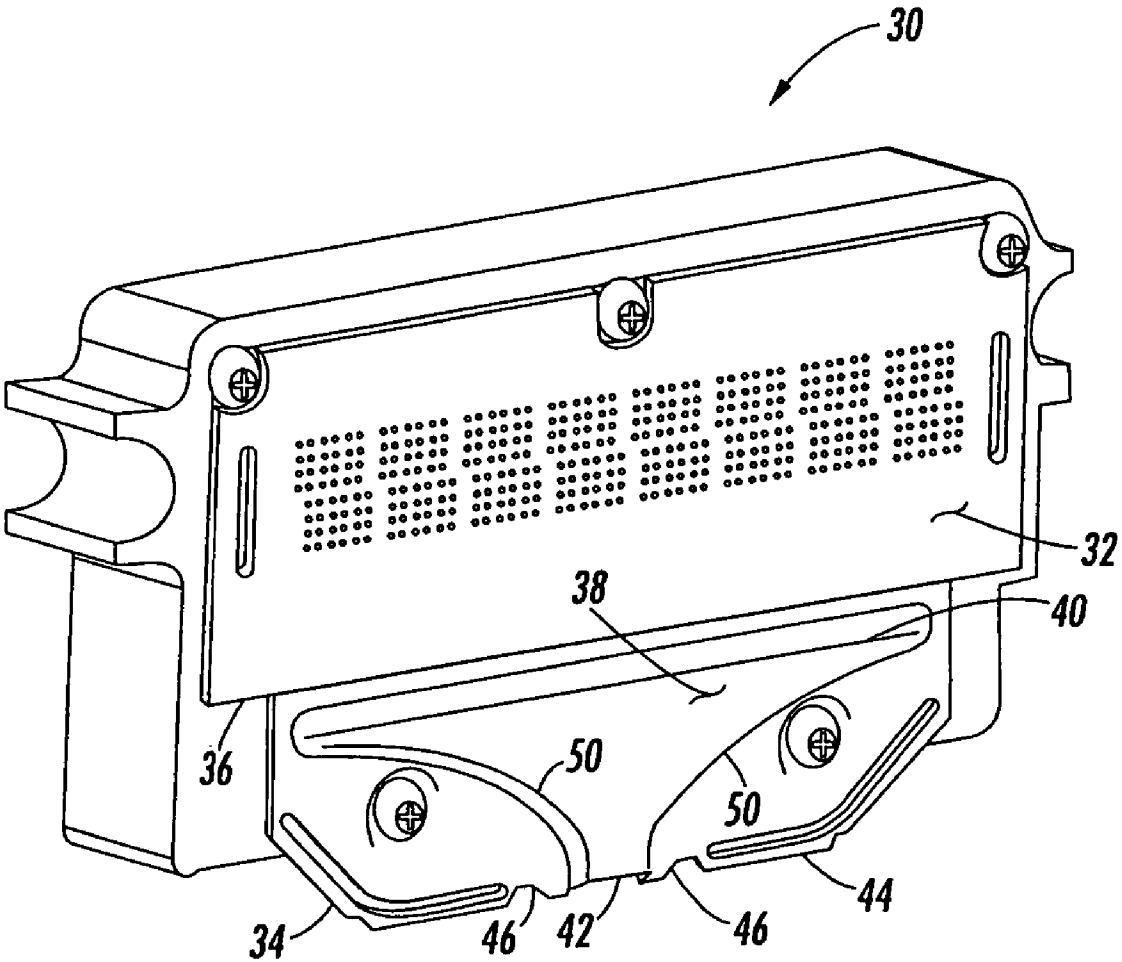
FIG. 2 is perspective view of a printhead according to an embodiment of the invention.

FIG. 2 is a perspective view of an embodiment of a printhead 30. The printhead 30 has a printhead face 32 that is structured to provide ink for printing. A waste ink drip bib 34 is attached to the printhead 30 adjacent to the lower edge 36 of the printhead face 32.

The drip bib 34 has a funnel structure 38 that includes an upper opening 40 extending across a portion of the printhead face 32 and a narrower lower opening 42. The lower opening 42, in this embodiment, is laterally located near the center of the width of the printhead face 32. The funnel structure 38 has depth extending perpendicular from the printhead face 32. The funnel 38 is structured to direct waste ink being purged from the printhead face 32 into the upper opening 40 to flow as a stream out of the lower opening 42. As will be discussed in more detail further, the drib bib 34 may have vertical reliefs 46 and downwardly sloping portions 50.

Figure 4:
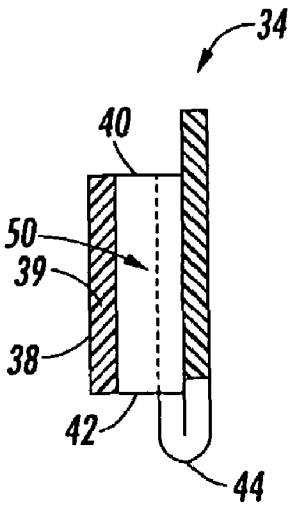
FIG. 4 is a cross-sectional view of the waste ink drip bib in FIG. 3 taken along line 4-4 in FIG. 3.
Figure 3:
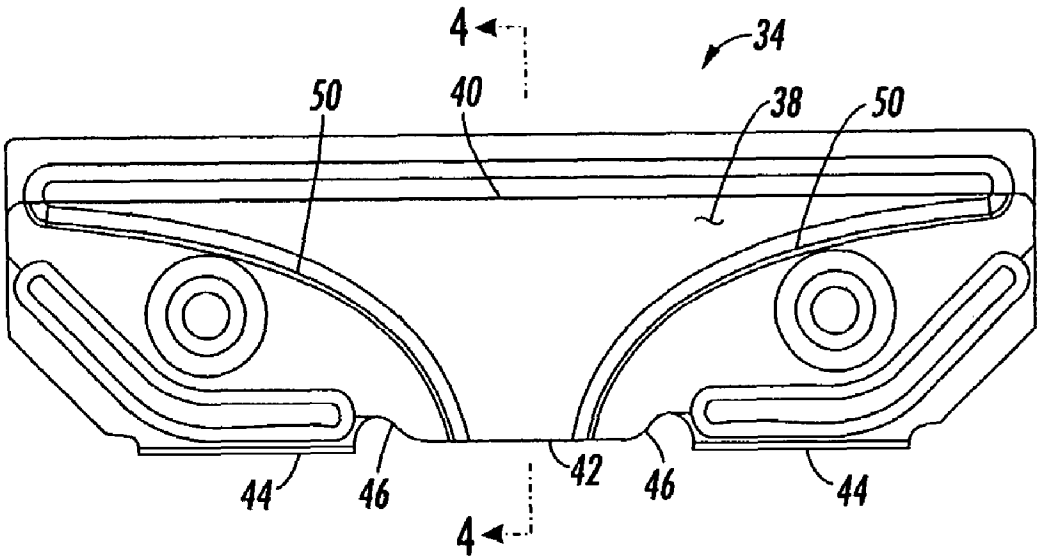
FIG. 3 is a front elevation view of an embodiment of a waste ink drip bib of a printhead.

FIG. 3 is a front elevation view of the waste ink drip bib 34 of FIG. 2. FIG. 4 is a cross-sectional view of the waste ink drip bib 34 in FIG. 3 taken along line 4-4 in FIG. 3. The drip bib 34 may be formed from a single piece of material that is folded in half. Cutouts and reliefs that will become the funnel structure 38 and other features may be formed in the material prior to folding. The fold 44 forms the bottom edge of the drip bib 34 with a cutout forming the lower opening 42.

The funnel structure 38, as shown in FIG. 4, includes wall front vertical wall 39 that is offset from the main portion of the drip bib body. The vertical wall 39 can be formed by pressing the material to offset the funnel shape prior to bending the material.

When the bib is formed by folding, the folded material helps to retain the waste ink within the drip bib 34 laterally to the lower opening 42 so that ink does not drip or splatter onto neighboring components. Vertical reliefs 46 can be further cut in the material on either side of the lower opening 42. The vertical reliefs 46 use the surface tension of the ink to help wick the ink off of the edge of the lower opening 42 so that satellite drops are eliminated or at least reduced.

Figure 5:
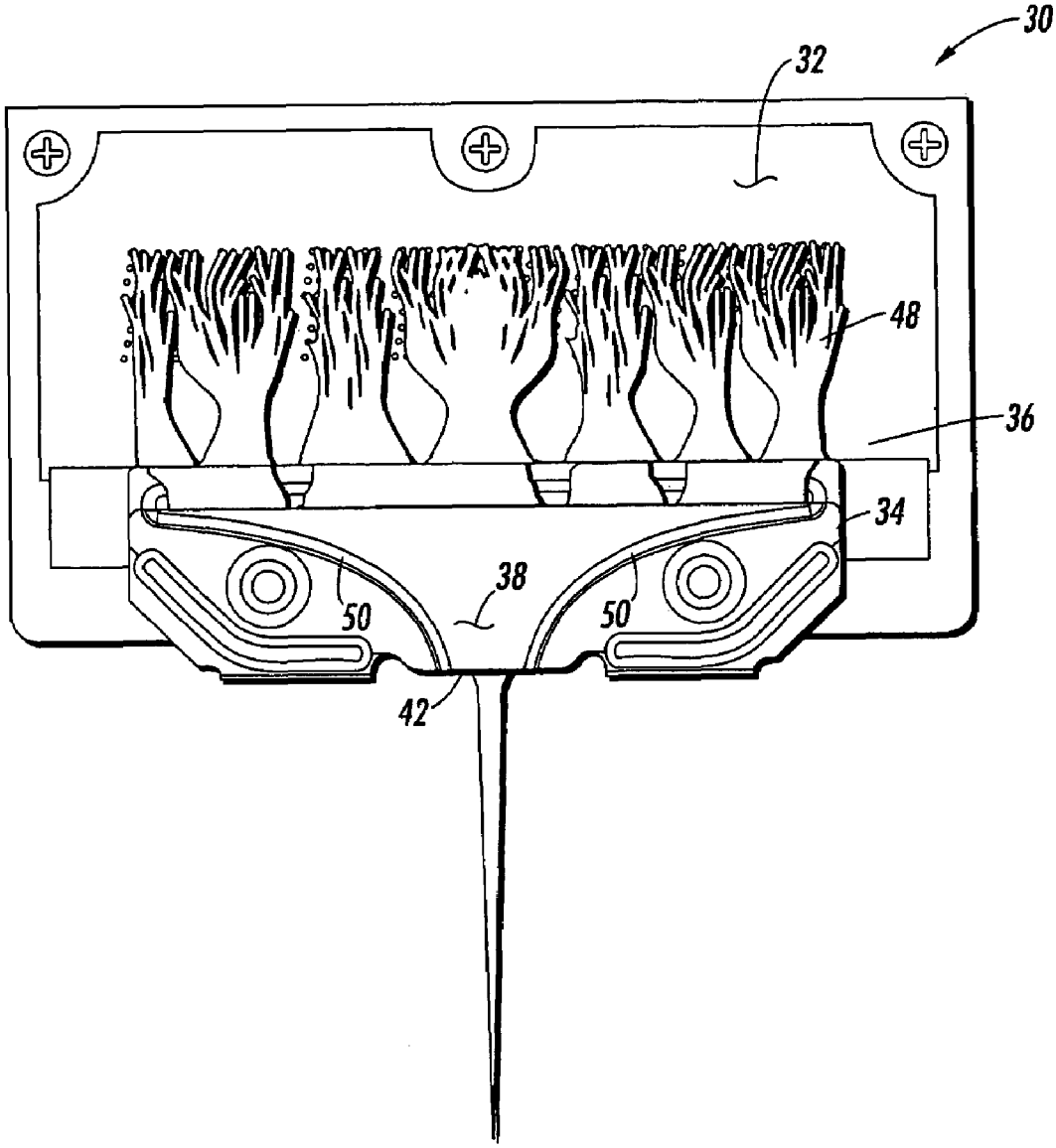
FIG. 5 is a front elevation view of an embodiment of a printhead showing waste ink flowing from the waste ink drip bib.

FIG. 5 is a front elevation view of the printhead 30 showing waste ink 48 flowing from the printhead face 32 and through the waste ink drip bib 34. The lower opening 42 in the drip bib 34 is sized to allow the waste ink 48 to flow in a stream from the drip bib 34 as shown in FIG. 5.

The lower opening 42 may be further sized to utilize the surface tension of the ink 48 to retain a small portion of the ink within the drip bib 34 at the lower opening 42 as the flow of ink 48 diminishes. The last of the waste ink is then retained within the drip bib 34 rather dripping off the drip bib 34 and possibly causing harmful satellite drops. The retained ink then can solidify near the lower opening 42. A subsequent flow of waste ink 48 then can remelt the retained ink and the subsequent ink 48 along with the retained ink flows in a steady stream out of the lower opening 42.

A method of disposing waste ink 48 from a printhead 30 will now be described with reference to FIGS. 2-5. Waste ink drip bib 34 is attached near the lower edge 36 of the printhead face 32. The waste ink drip bib 34 includes a funnel shape 38 that has downwardly sloping portions 50. The waste ink 48 is directed laterally with the downwardly sloping portions 50 to the lower opening 42 in the funnel 38.

As the flow of waste ink 48 diminishes, a small amount of ink is retained in the drip bib 34 near the lower opening 42 preventing drops from forming near the lower opening 42. The retained amount of ink is allowed to solidify and then a subsequent flow of waste ink 48 remelts this retained amount of ink.

Satellite drops are prevented from forming near the lower opening 42 by relieving the vertical edges 46 on either side of the lower opening 42. The vertical reliefs 46 eliminate a horizontal path from either side of the lower opening 42. Without the vertical reliefs 46, the surface tension of the waste ink could cause the in 48 to spread horizontally from the lower opening 42 thereby allowing unwanted satellite drops to form below this horizontal path. The flow of waste ink 48 is retained within the drip bib 34 because the drip bib 34 is formed from a single, piece of material, such as one formed by folding. The unopened lower parts 44 of the material form the bottom edge of the drip bib 34 on either side of the lower opening 42.

Figure 6:
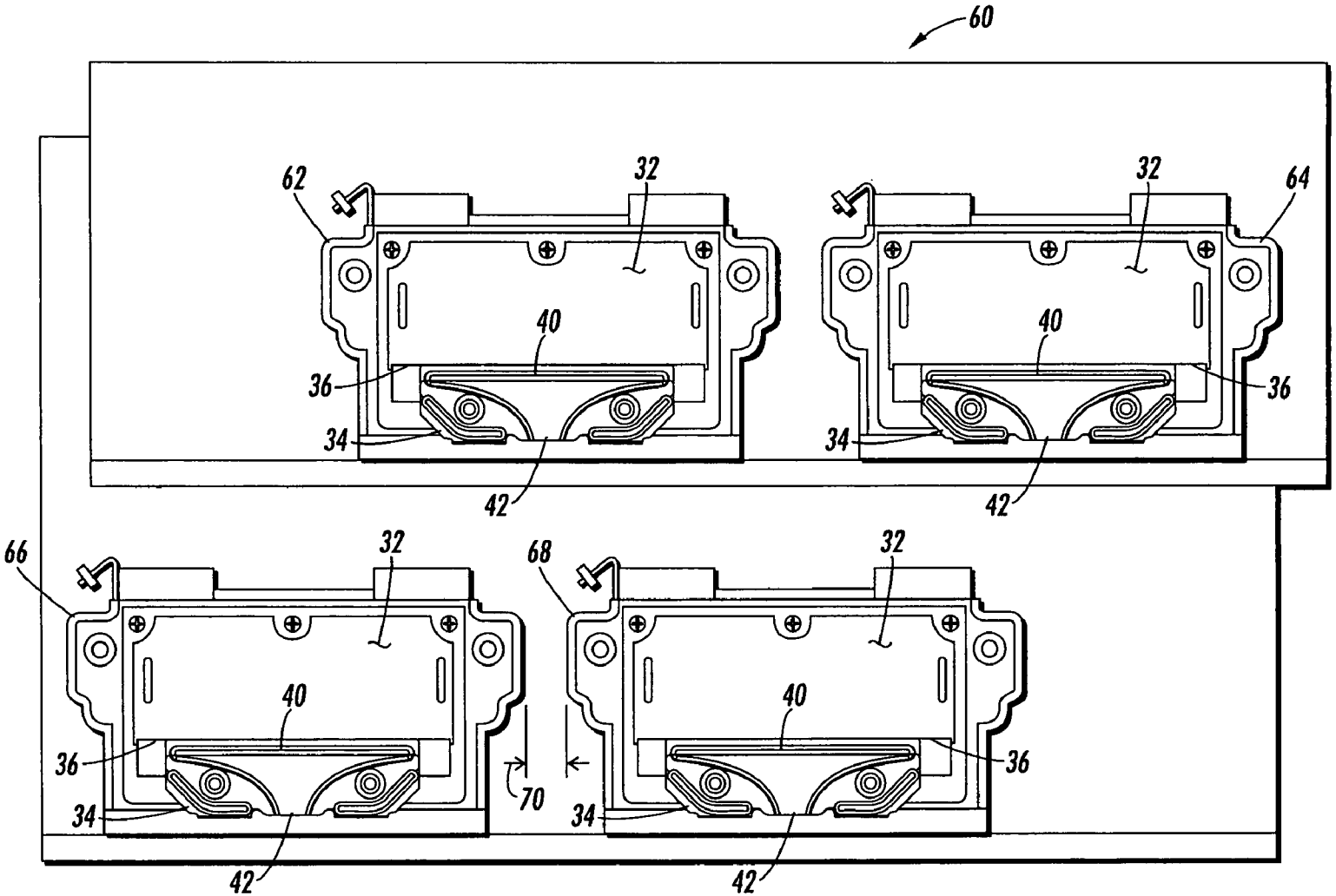
FIG. 6 is front elevation view of a portion of a printer according to another embodiment of the invention showing a plurality of printheads.

FIG. 6 is a front elevation view of a portion of printer 60 according to another embodiment of the invention showing a plurality of printheads 62, 64, 66 and 68. Each of these printheads has waste ink drip bib 34 positioned near the bottom edge 36 of the printhead face 32. Each drip bib includes lateral surfaces 50 that are substantially perpendicular to the printhead face 32 that are arranged to direct waste ink toward the center of the drip bib 34.

The sloping lateral surfaces 50 extend from an upper opening 40 down the centrally located lower opening 42. The lower opening 42 is sized to retain a predetermined amount of ink due to the surface tension of the ink when the flow of waste ink diminishes.

The printheads 62, 64, 66 and 68 are arranged in upper and lower rows. Upper printhead 62 is positioned above the two lower printheads 66 and 68 such that the lower opening 42 is located directly above a lateral gap 70 between the two lower printheads 66 and 68. The waste ink 48, as shown in FIG. 5, from the printhead 62 is then directed in a stream from lower opening 42 between the two lower printheads 66 and 68 into waste tray (not shown). Due to the features of the drip bib 34 described above, satellite drops are prevented from forming and possibly splattering and contaminating the lower printheads 66 and 68 or other neighboring components.

By directing the flow of waste ink to the centrally located lower opening 42 in the drip bib 34, the lateral positions of the upper printheads 62 and 64 can overlap with the lateral positions of the lower printheads 66 and 68.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A printhead comprising:

a printhead face having a lower edge; and a waste ink drip bib attached to the printhead positioned adjacent to the lower edge of the printhead face such that the waste ink drip remains attached to the printhead during operation of the printhead; and in which the waste ink drip bib includes a funnel.

2. The printhead of claim 1 in which the funnel includes an upper opening with a width extending across a portion of the lower edge of the printhead face, a narrower lower opening, and a depth extending perpendicular to printhead face.

3. The printhead of claim 2, in which the lower opening is laterally located near a center portion of the printhead face.

4. The printhead of claim 2 in which the lower opening is sized to allow waste ink to flow through the lower opening.

5. The printhead of claim 2 in which the lower opening is sized to retain a predetermined amount of ink in the funnel.

6. The printhead of claim 5 in which the lower opening is sized to retain a predetermined amount of ink retained in the funnel due to a surface tension of the ink.

7. The printhead of claim 5 in which the funnel is sized to allow a subsequent amount of waste ink to remelt the predetermined amount retained in the funnel to allow flow of the subsequent amount of waste ink through the lower opening.

8. The printhead of claim 2 in which the waste ink drip bib includes a vertically relieved portion laterally adjacent to the lower opening.

9. The printhead of claim 1, in which the waste ink drip bib is formed from a single piece of material bent substantially in half with the bend forming a lower edge of the drip bib.

10. A method of disposing waste ink from a printhead, comprising:

directing a flow of waste ink to a drip bib that includes a funnel shape positioned adjacent to a lower edge of the printhead face, the funnel shape extending perpendicular from the printhead face, the drip bib remaining attached to the print head during operation of the printhead; and directing the flow of waste ink laterally in the drip bib with downwardly sloping portions of the funnel shape to a lower opening in the funnel shape.

11. The method of claim 10, further comprising retaining a predetermined amount of waste ink near the lower opening of the funnel shape.

12. The method of claim 11, further comprising remelting the retained amount of waste ink with a subsequent amount of waste ink.

13. The method of claim 10, further comprising retaining a portion of the flow of waste ink within the drip bib by forming the drip bib from a single, substantially folded over piece of material.

14. The method of claim 10, in which directing a flow of waste ink includes directing a flow of waste ink to flow between two components positioned below the printhead.

15. A printer comprising: a plurality of printheads; and a corresponding plurality of waste ink drip bibs attached to the printhead such that the waste ink drip bibs remain attached to the printhead during operation of the printhead positioned near a bottom edge of a face of each corresponding printhead, in which each waste ink drip bib includes lateral surfaces substantially perpendicular to the face of the printhead arranged to direct waste ink to a designated lateral portion of the waste ink drip bib.

16. The printer of claim 15 in which the designated later portion of the waste ink drip bib is a centrally located portion of the waste ink drip bib.

17. The printer of claim 15 in which the waste ink drip bib includes an upper opening and a laterally centrally located lower opening.

18. The printer of claim 17 in which the lower opening is sized to retain a predetermined amount of ink due to a surface tension of the ink.

19. The printer of claim 15, in which the plurality of print heads are arranged with an upper printhead located above two lower printheads, the upper printhead positioned laterally such that the lower opening in the waste ink drip bib on the upper printhead is located directly above a lateral gap between the two lower printheads.

20. The printer of claim 15 in which the waste ink drip bib is formed from a single piece of material folded with a fold forming a bottom edge of the waste ink drip bib.

* * * * *